United States Patent [19]

Maier

[11] 4,114,827

[45] Sep. 19, 1978

[54] CABLE REEL VALVE AND SYSTEM

[75] Inventor: Albin Maier, Edinboro, Pa.

[73] Assignee: Snap-Tite, Inc., Union City, Pa.

[21] Appl. No.: 805,835

[22] Filed: Jun. 13, 1977

[51] Int. Cl.[2] ..... B65H 75/42

[52] U.S. Cl. ..... 242/86.51

[58] Field of Search ..... 242/86.51, 86.52; 137/540; 254/173 R

[56] References Cited

U.S. PATENT DOCUMENTS

| | | | |
|---|---|---|---|
| 2,395,302 | 2/1946 | Slomer | 242/86.51 |
| 2,654,547 | 10/1953 | Ball | 242/86.51 |
| 2,665,081 | 1/1954 | Slomer | 242/86.51 |
| 2,759,684 | 8/1956 | Cross | 242/86.51 |
| 3,158,356 | 11/1964 | Carlson | 242/86.51 |

*Primary Examiner*—Edward J. McCarthy
*Attorney, Agent, or Firm*—Woodling, Krost, Granger & Rust

[57] ABSTRACT

A cable reel control valve and associated system for controlling the operation of a hydraulic motor unit coupled to a reel mounted on a vehicle, such as a mine car or the like and wherein the reel is adapted to automatically wind electrical cable thereon as the mine car moves toward the point where the cable is connected to the source of power, and to automatically pay-out the cable as the mine car moves away from the electrical cable connection to the source of power. The cable reel control valve includes a pump port, and a motor port to which the motor for rotating the reel is coupled, and includes a pilot pressure operated bypass valve means for automatically sensing the pressure differential across the pump and motor ports and to automatically bypass the pump flow to reservoir when the cable reel is paying out the cable, and when the cable reel stops, and automatically diverts the full pump flow to the reel motor when the cable is being reeled in in response to movement of the vehicle toward the electrical connection to the source of power.

12 Claims, 6 Drawing Figures

CABLE REEL VALVE AND SYSTEM

This invention relates in general to valve structure and more particularly to a valve which is adapted to control a hydraulic powered motor for a reel adapted to wind up and pay-out electrical cable on a vehicle, such as a mine car, and more particularly relates to a regulator valve of the latter type which includes bypass valve means embodied therewith, for automatically sensing the pressure drop across the pump and motor ports of the valve, and to automatically bypass the pump flow to reservoir when the cable reel is paying out cable, and when the reel is stopped or stalled, and which diverts the full pump flow to the reel motor when the cable is reeled in responsive to movement of the mine car in a direction toward the electric connection of the cable to the source of power.

BACKGROUND OF THE INVENTION

Control or regulator valves for cable reels are known in the prior art. However, such prior art valves are not entirely satisfactory and are generally quite complex and expensive and are not generally easily repairable. Moreover, such prior art reel regulator valves will not ordinarily bypass the pump port pressure unless the motor port pressure exceeds the pump port pressure. In the present arrangement, as aforementioned, the regulator valve is such that the pump pressure is automatically bypassed to reservoir when the cable reel is stopped or stalled.

SUMMARY OF THE PRESENT INVENTION

The present invention provides a regulator valve and associated system for use with a hydraulic powered motor unit for a reel adapted to automatically wind up and pay out electrical cable responsive to associated vehicle movement, and wherein the valve includes bypass valve means therein which automatically senses the pressure drop across the pump and motor ports of the valve, and automatically bypasses the pump flow to reservoir either when the cable reel is stalled or stopped, or when the cable reel is paying out the cable, and which acts automatically to divert the full pump flow to the reel motor when the cable is being reeled in responsive to movement of the mounting vehicle toward the electrical connection of the cable.

Accordingly, an object of the invention is to provide a novel regulator or control valve for a cable reel system.

A still further object of the invention is to provide a novel regulator valve for a cable reel system which includes a pump port, and a motor port to which the motor for rotating the reel is coupled, and which includes a pilot pressure operated bypass valve mechanism for sensing the pressure differential across the pump and motor ports and to automatically bypass the pump flow to reservoir when the cable reel is paying out the cable and when the cable reel stops or stalls, and which is operative to automatically divert the full pump flow to the reel motor when the cable is being reeled in responsive to movement of the supporting vehicle toward the electrical connection or tie-off point of the cable to the source of electrical power.

A still further object of the invention is to provide a valve of the latter discussed type which includes valve means coacting with the bypass valve mechanism, with the valve means being adjustable from externally of the control valve housing, and providing for selectively setting the motor pressure to the lowest possible value when the cable reel is stalled or stopped.

A still further object of the invention is to provide a control valve of the above discussed type which is easier to maintain as compared to heretofore known reel regulator valves.

A still further object of the invention is to provide a control system for winding and unwinding a power supply cable, and including a reel mounted on a vehicle for winding the cable, with the reel being activated by a hydraulic motor and comprising a regulator valve for automatically controlling the operation of the hydraulic motor, with the valve connected to a hydraulic pump and having a motor port connected to the motor, and with the valve including pressure operated bypass means which communicates with the pump and motor ports of the valve, and automatically senses any pressure differential across the pump and motor ports so as to supply full pump pressure to the motor port when the reel is reeling in the cable, and for bypassing the pump pressure from the pump port to reservoir when the reel is paying out the cable responsive to movement of the vehicle, and when the reel motor is stalled or stopped.

Other objects and advantages of the invention will be apparent from the following description taken in conjunction with the accompanying drawings wherein:

DESCRIPTION OF PREFERRED EMBODIMENT

Reference 10 refers to the mounting vehicle, which in the embodiment illustrated is a mine car, on which the control system for automatically winding and unwinding an electric cable C is mounted. The mine vehicle is mounted on wheels 12 for movement of the vehicle over the surface S which may include tracks for guiding the wheels 12. The electric cable C is connected to a source of electrical power which is conventionally referred to as the tie-off point 13 for the cable.

Figure 1:
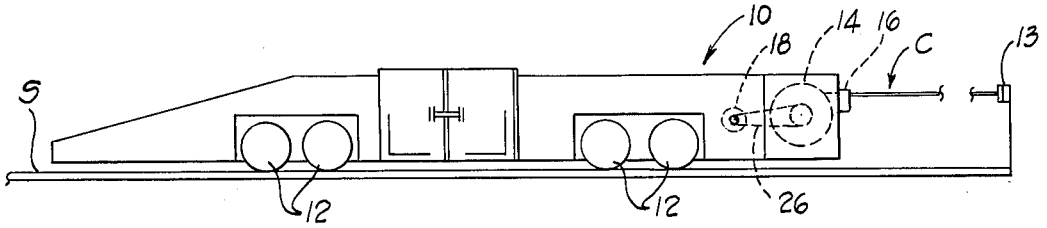
FIG. 1 is a diagrammatic illustration of a mounting vehicle, and more particularly a mine vehicle, on which is mounted a control system of the invention for automatically winding and unwinding an electric power cable by means of a reel mounted on the vehicle.
Figure 2:
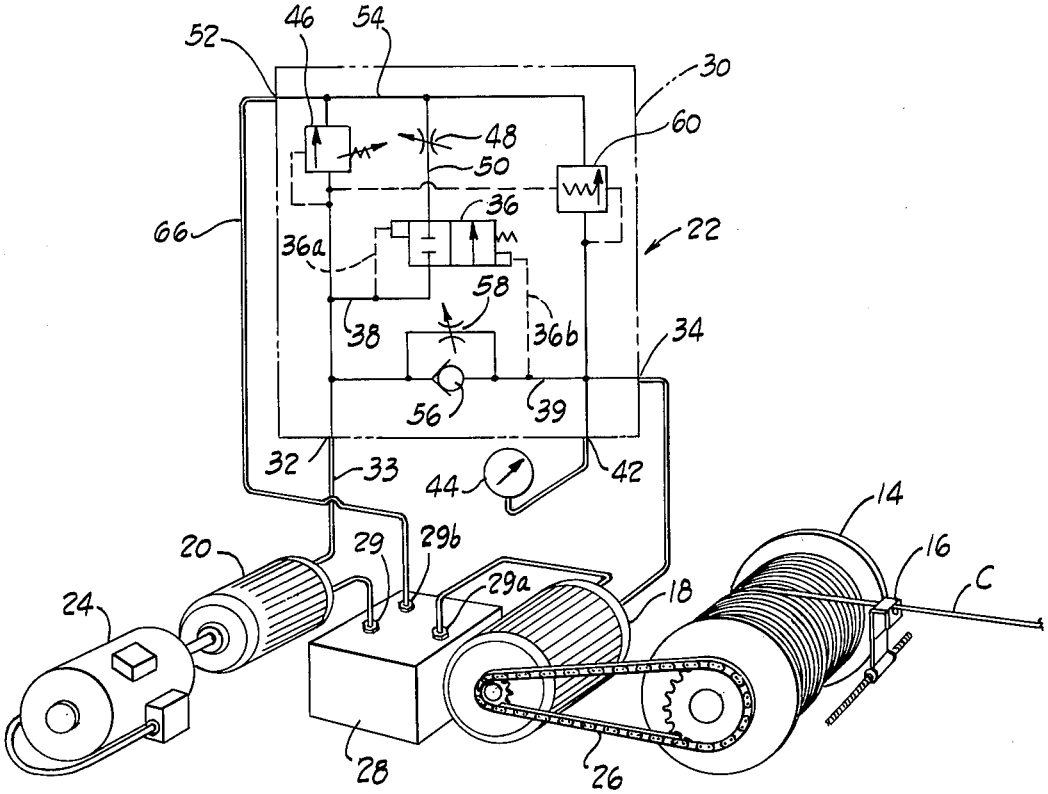
FIG. 2 is a diagrammatic illustration of the system of the invention, illustrating the pump, hydraulic motor, the cable reel coupled to the motor for winding up the electric cable, and showing schematically the regulator valve of the invention.

The system includes a reel 14 (FIG. 2) for winding the electrical cable C thereon and may include a cable guide 16 for guiding the cable onto and off of the reel. The reel is activated during the winding up of the cable by means of a hydraulic motor 18, which is adapted to be supplied with pressurized actuating liquid by means of a pump 20 which is preferably of the constant volume type, with the application of pressurized liquid being controlled by means of regulator valve 22, with which the present invention is particularly concerned. The pump 20 may be driven by means of an electric motor 24, and a positive drive 26 may couple the hydraulic motor 18 to the cable reel for rotation of the latter. A reservoir tank 28 is provided in the system coupled as at 29, **29*a* and 29*b* to respectively the pump 20, the hydraulic motor 18, and the regulator valve 22**.

Regulator valve 22 controls the operation of the hydraulic motor unit 18 whereby the reel 14 operatively coupled to the hydraulic motor 18, is operable to automatically wind up electrical cable thereon, as the mine car moves toward the tie-off point 13 where the cable is connected to a source of power, and pays out the electric cable as the mine car moves away from the electrical cable tie-off point 13.

Valve 22 includes a housing 30 having a pump port 32 coupled by conduit 33 to the output port of the hydraulic pump 20, and a motor port 34 coupled to the input port of the hydraulic motor 18. Embodied in the valve housing 30 is a pilot pressure operated bypass valve means 36 which is a cartridge type, normally open, pressure operated shutoff valve, and which is coupled by pilot lines **36*a*, 36*b* to fluid passage 38, 39 respectively in the regulator valve housing. Valve 36 is operable to automatically sense the pressure differential between the pump and motor ports 32 and 34 and to automatically bypass the pump flow to the reservoir when the cable reel is paying out the electric cable C during the reel-out mode of operation and when the cable reel stops or is stalled during the stand-by mode. When the vehicle moves toward the point 13 of connection of the electrical cable to the source of electric energy, the bypass valve means 36 is operable to automatically divert the full pump flow to the hydraulic motor 18 to wind up the cable during the reel-in mode. The housing 30 of the regulator valve may be provided with a gauge port 42, to which may be coupled a gage 44 for visually indicating the pressure in pressure passageway 39**.

A high pressure relief valve 46 is provided which also is preferably of the cartridge type for ready replacement, and which is coupled to the valve body 30 as by means of a threaded connection. Such high pressure relief valve 46 is adapted to maintain the proper tension in the electric cable C during the reeling-in mode of operation, and limits the hydraulic motor 18 pressure to a preset value, by bypassing any excess pump flow to the reservoir 28. Valve 46 is adjustable and in this connection is provided with a removable cover **46*a* (FIG. 3) which upon removal exposes an adjusting socket for turning, which is adapted to selectively increase or decrease the pressure under which the relief valve will operate. A nominal pressure of approximately 450 psig is recommended for the relief valve, but as aforementioned, the pressure to which the valve is adjusted should be high enough to maintain proper tension of the electric cable C under all operating conditions. After adjustment of the valve 46, the cover 46*a*** can be replaced, thereby locking the adjusting screw or socket thereof in place.

Figure 3:
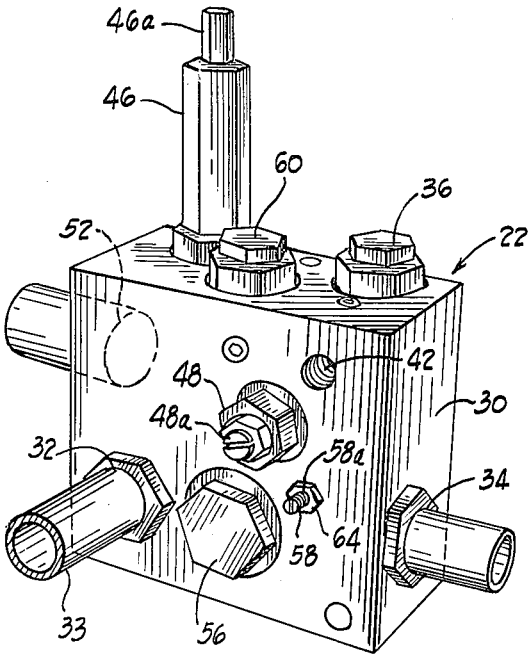
FIG. 3 is a perspective exterior view of the regulator valve schematically illustrated in FIG. 2.

A low pressure adjustable needle valve 48 is coupled to the bypass valve 36 by means of pressurized fluid passageway 50, and then is coupled to the reservoir port 52 in the valve body via pressure passageway 54. Valve 48 which is adjustable from exteriorly of the housing 30 is adapted to conserve horsepower input by providing an external means of setting the motor 18 pressure to the lowest possible value when the cable reel 14 is stopped or stalled during the stand-by mode. Valve 48 is adjustable by means of a rotatable slotted head **48*a* (FIG. 3). Such valve 48 provides a means for setting the standby pressure to the motor 18** at the lowest possible value, thereby reducing heat buildup and conserving power.

Disposed in fluid passage 39 is a check valve 56 which is adapted to create sufficient pressure diferential between the pump and motor ports 32, 34 to enable closing of the bypass valve to automatically provide for rotation of the cable reel motor in a direction to cause reeling in of the electric cable onto the reel responsive to movement of the vehicle in a direction toward tie-off point 13. Here again the check valve is preferably of the cartridge type, which enables major component replacement without removing the entire valve assembly 22 from the system, with the check valve being for instance screw threaded into the body 30 of the regulator valve.

An exteriorly accessible needle valve 58 sraddles (is disposed in parallel with) the check valve 56, and provides an externally adjustable means for metering fluid into the system during the stand-by mode (FIG. 5) to compensate for reel motor leakage. Valve 58 is provided with a slotted adjusting shank **58*a* (FIG. 3) for ready adjustment thereof. Compensating leakage for the reel motor 18 will generally vary, depending on the make and model of the motor, and adjustable valve 58** provides a means for adapting to such varying leakage requirements.

A sequence valve 60 which is normally closed, is provided, and which is adapted to automatically shift to open position to permit flow therethrough, when the reel motor reverses rotation to pay out the cable during the reel-out mode responsive to the vehicle moving away from the point of connection 13 of the electrical cable to the source of electrical energy. Valve 60 thus provides a flow path from the motor 18 to the reservoir during the reel-out mode (FIG. 4) responsive to movement of the vehicle away from the electrical cable connection point 13.

Initially the regulator valve 22 may be calibrated as follows: The low pressure adjusting screw head **48*a* of low pressure valve 48 is turned counterclockwise and the adjusting shank 58*a* of needle valve 58 is turned fully clockwise until both screws bottom. The pump 20 is then actuated and the cover 46*a* is removed from the high pressure relief valve 46, and the exposed adjusting screw thereof is turned clockwise to increase the pressure or counterclockwise to decrease the pressure until a nominal pressure of approximately 450 psig as viewed on gauge 44** is obtained. That takes care of the high pressure setting.

For calibrating the low pressure setting, the needle valve screw **58*a* is then turned counterclockwise (opened) until the motor pressure of hydraulic motor 18 drops. The low pressure adjusting screw 48*a* is then turned clockwise (closed) until the motor pressure of the hydraulic motor 18 is high enough to start the reel turning, which in the embodiment illustrated is approximately 200 to 300 psig. If the motor pressure increases rapidly when closing adjusting screw 48***a*, the needle valve screw 58*a* may by opened slightly further. That completes the low pressure setting of the system.

The final needle valve setting is then accomplished by closing the needle valve adjusting screw 58*a*, until the motor pressure rapidly increases to the high relief valve setting of approximately 450 psig. The needle valve 58 should then be slowly opened until the motor pressure drops to the low pressure setting of approximately 200 to 300 psig. Thereafter the needle valve 58 adjustment should be locked in position by means of the associated lock nut 64 (FIG. 3).

Figure 4:
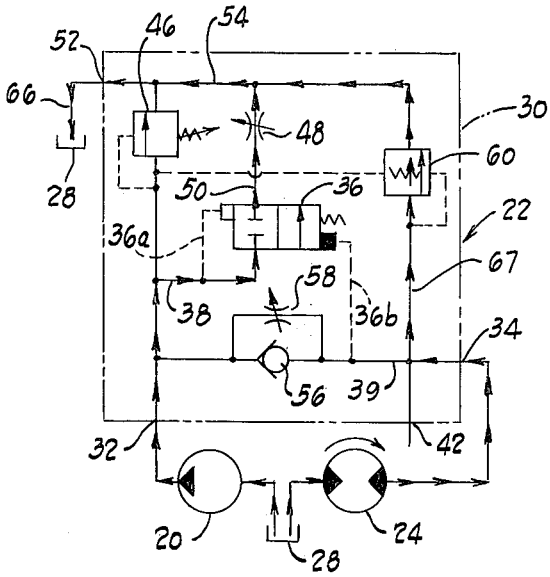
FIG. 4 is a schematic of the control valve of FIG. 3, and showing the flow of pressurized fluid therethrough during the paying out of electrical cable from the vehicle, or in other words when movement of the vehicle is away from the point of connection of electric cable to the source of electrical energy.

Referring now to FIG. 4 which schematically illustrates the reel-out mode of operation which occurs as the vehicle mounting the control system is moving away from the point of connection 13 of the electric cable to the source of electrical energy, the direction of rotation of the reel motor 18 is reversed with respect to its normal direction of rotation, due to the anchored pull on the cable, thereby pumping fluid from the reservoir into the motor port 34 as shown in FIG. 4. This backflow of fluid causes the motor port pressure to exceed the pump port 32 pressure, thereby opening the nonadjustable sequence valve 60 and pressure bypass valve 36. Flow from the pump 20 is thus directed through passage 38, through the bypass valve 36, and the low pressure needle valve 48 to reservoir port 52, and thence via flow line 66 to reservoir 28, while the flow from the hydraulic motor 18, entering motor port 34 is directed through the valve passage 67, the sequence valve 60 and then via passage 54 to reservoir port 52 in the regulator valve 22, and thence to reservoir 28.

Figure 5:
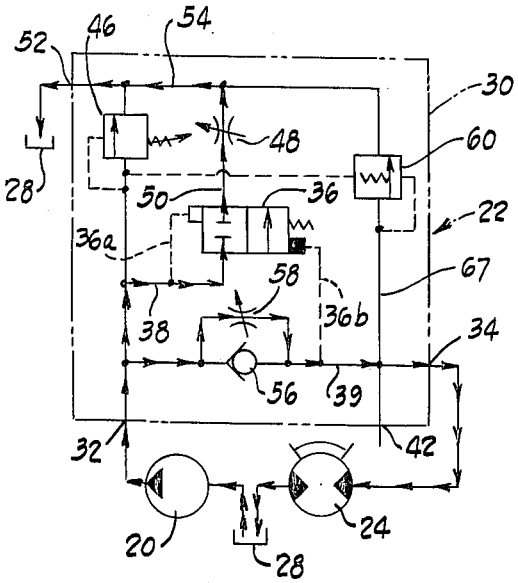
FIG. 5 is a schematic of the valve of FIG. 4 illustrating the flow of pressurized fluid therethrough in the stand-by mode thereof, or in other words, when the hydraulic motor which activates the cable reel is stalled or stopped responsive to non-movement of the vehicle.

Referring now to the schematic of the regulator valve illustrated in FIG. 5 showing the stand-by mode, when the vehicle supporting the control system stops so that it is no longer moving with respect to the point 13 of connection of the electric cable to the source of electrical energy, the hydraulic motor 18 is stalled and requires only internal leakage flow which is provided through the adjustable needle valve 58. The pressure difference between the pump and motor ports will be less than approximately 25 psig which is insufficient to hold the shutoff or bypass valve 36 closed. Accordingly, the pilot pressure operated bypass valve 36 automatically selects the open position, and thus bypasses the incoming pump flow to the reservoir port 52 through low pressure variable restrictor needle valve 48. As aforementioned, restrictor valve 48 is adapted to maintain the pressure at a level high enough to restart rotation of the reel motor 18 responsive to movement of the vehicle toward cable connection point 13. The nonadjustable sequence or relief valve 60 which also senses the pressure differential between the pump and motor ports is spring loaded in closed condition, while the high pressure adjustable relief valve 46 remains closed because the pressure level is less than the relief valve setting (e.g. 450 psig).

Figure 6:
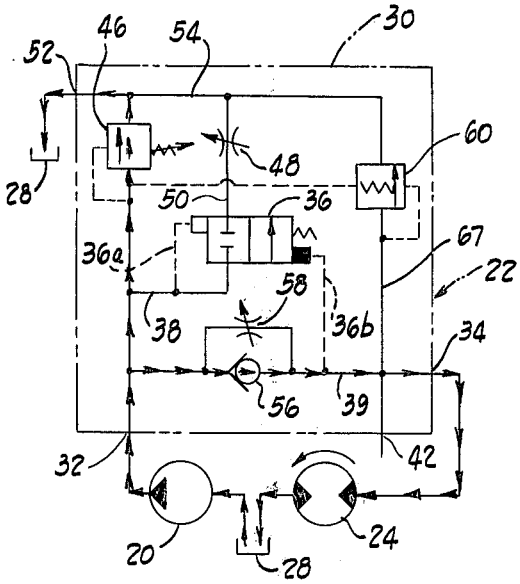
FIG. 6 is a schematic of the valve of FIG. 4, but showing the reel-in mode of operation when the reel is reeling in the electric cable responsive to movement of the mounting vehicle toward the point of connection of the cable to the source of electric power.

Referring now to the FIG. 6 schematic which illustrates the reel-in mode as the vehicle or mine car moves toward the cable tie-off point 13, thereby momentarily reducing the cable tension. This permits the reel motor 18 to begin rotating in the direction of the arrow illustrated. The check valve 56 in the flow path 39 produces a pressure difference across the pressure operated bypass valve 36, thereby causing automatic closing of the valve 36 and thus shutting off fluid flow therethrough. Fluid flow from the pump 20 is then available to the reel motor 18 and any excess flow is relieved through the high pressure adjustable relief valve 46. The sequence valve 60 is held closed by the combination of its spring force and the pressure differential between the pump and motor ports 32, 34.

From the foregoing discussion and accompanying drawings it will be seen that the invention provides a novel control system for winding and unwinding a power supply cable for a vehicle, and which includes a reel for winding the cable, a hydraulic motor for activating the reel, a pump for furnishing pressurized fluid to activate the motor and a regulator valve for controlling the application of pressurized fluid from the pump to control rotation of the reel, with the control valve including in the housing thereof a pressure operated bypass valve means communicating with the pump and pressure ports, and operable to automatically sense the pressure differential between the pump and motor ports so as to automatically supply full pump pressure to the motor port when the reel is reeling in the supply cable, and for bypassing the pump pressure from the pressure port to reservoir when the reel is paying out the supply cable responsive to movement of the vehicle away from the cable connection point, and when the reel motor is stalled or stopped.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A regulator valve for use with a cable reel mechanism to control the operation of a fluid powered motor unit that drives the cable reel, said valve including a housing, having a port adapted for coupling to a source of pressurized fluid, such as a constant output hydraulic pump, and a motor port adapted for coupling to the motor unit for the reel, and a reservoir port adapted for coupling to a fluid reservoir, and a pressure operated bypass valve in said housing communicating with said pump, reservoir and motor ports, and being operable to automatically sense the pressure differential across said pump and motor ports, so as to supply full pump pressure to the motor port when the reel is reeling in the cable and for bypassing the pump pressure from the pump port to reservoir when the reel is reeling out the cable and when the reel motor is stalled.

2. A valve in accordance with claim 1 including a needle valve coacting with said bypass valve and disposed between the latter and said reservoir port, said needle valve being adjustable from externally of said valve housing and providing for setting the motor unit pressure to the minimum pressure required to insure cable reel motor restarting from the stalled condition.

3. A valve in accordance with claim 1 including a sequence valve in said housing communicating between said motor port and said reservoir port, said sequence valve being normally closed but being operative to shift automatically to open position responsive to increased pressure at said motor port, to provide a flow path from the motor to reservoir during said reeling out mode.

4. A valve in accordance with claim 1 including a high pressure relief valve in said housing coacting with said pump port, said relief valve being adapted to maintain proper cable tension during said reel in mode of operation, by limiting the motor port pressure to a preset value and by bypassing any excess fluid pressure above said preset value, from the pump port to said reservoir port.

5. A valve in accordance with claim 1 including a check valve in said housing communicating with and disposed between said pump port and said motor port, said check valve being operable to allow fluid flow from said pump port to said motor port, and being closed in the reverse direction.

6. A valve in accordance with claim 1 including a high pressure relief valve in said housing communicating with said pump port for maintaining proper cable tension during the reel-in mode by limiting the motor port pressure to a preset value, and also including an externally adjustable valve in said housing which is coupled between said reservoir port and said bypass valve for providing an external means of setting the motor port pressure to the minimum pressure required to insure cable reel motor restarting from the stalled condition of the reel motor.

7. A valve in accordance with claim 5 including a needle valve in said housing disposed between said pump port and said motor port and in parallel to said check valve, said needle valve providing fluid flow to compensate for reel motor leakage during the stalled condition of the reel motor, and being adjustable from exteriorly of said housing.

8. In a control system for winding and unwinding a power supply cable for an electrically powered vehicle, such as a mine car, comprising, a reel for winding the cable, a hydraulic motor coupled to the reel for activating the latter, a constant output pump for furnishing pressurized fluid to activate said motor, a reservoir for activating fluid, and a regulator valve for controlling the application of pressurized fluid from said pump to said motor to control rotation of said reel, said valve including a housing having a pump port coupled to said pump, a motor port coupled to said hydraulic motor, a reservoir port coupled to said reservoir, and a pressure operated bypass valve in said housing communicating with said pump, reservoir and motor ports, and being operable to automatically sense the pressure differential across said pump and motor ports so as to supply full pump pressure to the motor port when the reel is reeling in said supply cable and for bypassing the pump pressure from the pressure port to reservoir when the reel is reeling out the supply cable and when the reel motor is stalled.

9. A system in accordance with claim 8 including a selectively adjustable high pressure relief valve in said housing coacting with said pump port, said relief valve being operative to maintain proper cable tension during the reel-in mode of operation, by limiting motor pressure to a preset value, and by bypassing any excess fluid pressure from the pump to reservoir.

10. A system in accordance with claim 8 including a check valve in said housing communicating with and disposed between said pump port and said motor port, said check valve being openable in the direction of flow from said pump to said motor port.

11. A system in accordance with claim 9 including a sequence valve in said housing communicating between said motor port and reservoir, said sequence valve being normally closed but being operable to automatically shift to open condition responsive to increased pressure at said motor port, to provide a flow path from said motor to reservoir during said reeling out mode of operation.

12. A system in accordance with claim 11 wherein said valve housing includes an externally adjustable valve coupled between reservoir and said bypass valve for setting the motor port pressure to the minimum pressure required to insure restarting of said motor from stalled condition responsive to a movement of the mounting vehicle which requires said motor to start and to cause actuation of said reel to reel in the cable, said relief valve, said sequence valve, said bypass valve and said low pressure valve being of the cartridge type and readily removable from and replacable into said housing.

* * * * *